US006863112B1

(12) United States Patent
Ayers et al.

(10) Patent No.: US 6,863,112 B1
(45) Date of Patent: Mar. 8, 2005

(54) WINDOW INSULATING DEVICE, KIT AND SYSTEM

(76) Inventors: Roger Ayers, 5124 La Fiesta, NE., Albuquerque, NM (US) 87109; Marguerite McCarthy-Ayers, 5124 La Fiesta, NE., Albuquerque, NM (US) 87109

( * ) Notice: Subject to any disclaimer, the term of this patent is extended or adjusted under 35 U.S.C. 154(b) by 66 days.

(21) Appl. No.: 10/290,729

(22) Filed: Nov. 7, 2002

Related U.S. Application Data

(60) Provisional application No. 60/338,022, filed on Nov. 7, 2001.

(51) Int. Cl.[7] ..... A47G 5/00

(52) U.S. Cl. ..... 160/371; 160/354; 160/368; 49/61; 52/656

(58) Field of Search ..... 160/371, 354, 160/368, 380; 52/656; 49/61; 403/402, 295

(56) References Cited

U.S. PATENT DOCUMENTS

| | | | | | |
|---|---|---|---|---|---|
| 2,226,254 | A | | 12/1940 | Owen | |
| 2,514,316 | A | | 7/1950 | Dobrin | |
| 2,612,947 | A | | 10/1952 | Jenks | |
| 2,691,193 | A | | 10/1954 | Wissinger | |
| 2,741,306 | A | | 4/1956 | Warp | |
| 2,784,781 | A | * | 3/1957 | Rhoades | 160/371 |
| 2,825,941 | A | | 3/1958 | Lux et al. | |
| 2,989,788 | A | | 6/1961 | Kessler | |
| 3,255,810 | A | * | 6/1966 | Rowbottam | 160/354 |
| 3,363,390 | A | | 1/1968 | Crane et al. | |
| 3,752,730 | A | * | 8/1973 | Koff | 428/13 |
| 3,997,144 | A | * | 12/1976 | Parisien | 256/32 |
| 4,068,428 | A | | 1/1978 | Peterson, III | |
| 4,136,496 | A | | 1/1979 | Molyneux | |
| 4,407,099 | A | | 10/1983 | McLaughlin | |
| 4,441,290 | A | | 4/1984 | Abell | |
| 4,453,585 | A | | 6/1984 | Ruggeberg et al. | |
| 4,486,990 | A | | 12/1984 | Bauch | |
| 4,570,406 | A | | 2/1986 | DiFazio | |
| 4,599,825 | A | | 6/1986 | Sixsmith | |
| 4,733,510 | A | | 3/1988 | Werner | |
| 4,817,655 | A | | 4/1989 | Brooks | |
| 5,059,218 | A | * | 10/1991 | Pick | 96/66 |
| 5,207,040 | A | | 5/1993 | Lovell | |
| 5,547,011 | A | * | 8/1996 | Dotson et al. | 160/381 |
| 5,737,885 | A | | 4/1998 | Stoyke | |
| 6,052,957 | A | | 4/2000 | Minnich | |
| 6,073,675 | A | * | 6/2000 | Dannaher | 160/369 |
| 6,108,997 | A | * | 8/2000 | Blais et al. | 52/656.7 |
| 6,305,132 | B1 | | 10/2001 | Smith | |
| 6,390,173 | B1 | * | 5/2002 | Story, Jr. | 160/371 |
| 2003/0196770 | A1 | * | 10/2003 | Wylie | 160/371 |

* cited by examiner

*Primary Examiner*—Bruce A. Lev
(74) *Attorney, Agent, or Firm*—Stephen A. Slusher; Peacock Myers & Adame, P.C.

(57) ABSTRACT

An interior storm or insulating window, kit for making, and system for utilizing, which window is adjustable in length and width so as to fit different sized window frames, and includes rails around the perimeter with a groove for attaching a retainer strip, the rail further including an engaging cavity to joining to other components, corner brackets for joining rails, a flexible plastic film and a retainer for retaining the flexible plastic film within the groove and for retaining the window within a window frame by use of a flexible spline.

20 Claims, 9 Drawing Sheets

WINDOW INSULATING DEVICE, KIT AND SYSTEM

CROSS-REFERENCE TO RELATED APPLICATION

This application claims the benefit of the filing of U.S. Provisional Patent Application Ser. No. 60/338,022 entitled Window Insulating Device, kit and System, filed on Nov. 7, 2001, and the specification thereof is incorporated herein by reference.

BACKGROUND OF THE INVENTION

1. Field of the Invention (Technical Field)

The present invention relates to an interior storm or insulating window, kit for making the same, and system for utilizing the same, which insulating window is adjustable in length and width so as to fit different sized window frames, and is made from light-weight plastic, composite or polymeric materials.

2. Background Art

Note that the following discussion refers to a number of publications by authors and year of publication, and that due to recent publication dates certain publications are not to be considered as prior art vis-a-vis the present invention. Discussion of such publications herein is given for more complete background and is not to be construed as an admission that such publications are prior art for patentability determination purposes.

A number of light-weight interior storm or insulating windows are known. These generally are fitted inside the window frame on the interior of a window, and incorporate either glass or polymeric material coverings, which may be opaque, translucent or transparent. These function, in part, by forming a "dead air" space between the exterior window glazing and the interior storm or insulating window, and further by limiting convection currents over the window.

Prior art structures typically utilize a frame member on each of the four sides of the frame. The frame is fastened to the window by any of a variety of means, such as magnetic strips, Velcro® type fiber and loop locking strips, adhesive strips, compression-type holding means, such as foam strips, and the like. Prior art products are illustrated, for example, in U.S. Pat. Nos. 4,407,099, 4,486,990, 4,599,825, 5,207,040 and 6,052,957.

Most prior art structures employ mitered corners, such as corners at a 45° angle. See, for example, U.S. Pat. Nos. 5,737,885, 2,989,788, 2,691,193 and 4,733,510. This requires that the structures be factory made in a variety of sizes, in order result in even corner joints, or be made by a skilled craftsperson capable of fabricating mitered corners.

There remains a need for an interior storm or insulating window or system which can easily be adjusted to any of a large variety of rectangular sizes, which is aesthetically pleasing, and which can readily and easily be mounted and removed without the use of tools or permanent attachment means, such as magnetic, adhesive or Velcro® strips that deface the window frame when the interior storm or insulating window is not mounted. In addition, the interior storm or insulating window must be easily and readily removable to permit unencumbered egress through the window in the case of emergencies.

SUMMARY OF THE INVENTION (DISCLOSURE OF THE INVENTION)

The invention provides a storm window for fitting within the interior of an existing window frame. The storm window includes at least four rails of uniform cross-section, each rail having a uniform width and height with a length determined by the dimensions of the existing window frame, with each end of each rail terminating at a right angle, with an engaging cavity having a defined shape and dimension within the interior along the length of each rail and with at least one groove with a defined shape and dimension along at least one width of each rail. The rails are joinable to corner brackets, the invention providing at least four corner brackets, each corner bracket having a first face and second face for contacting rails, the first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein. The invention further includes a flexible plastic film and at least four retainers of uniform cross-section, each retainer have a length determined by the dimensions of the existing window frame, with each retainer having a groove attachment member shaped and dimensioned for engaging with the at least one groove of a rail, and a flexible spline for compressibly engaging the existing window frame. In the practice of the invention, the ends of each rail are joined to a corner bracket by means of the joining members so as to form a rectangular shape, the flexible plastic film is positioned on one side of the rectangular shape and is secured by engagement between groove attachment members of the retainers and grooves of the rails, and the resulting rectangular shape with flexible plastic film secured thereto is fitted within the existing window frame by means of compressible engagement of the flexible spines of the retainers.

In the invention the corner brackets can include at least one plate extending over at least a portion of the first face and second face for contacting rails, such that the juncture of the corner bracket and rail is at least particularly covered by the plate. The corner brackets can further include a third face and fourth face opposite the first face and second face, the third and fourth faces disposed at right angles and each having a groove with a defined shape and dimension along the face such that the groove is continuous with the groove of a rail joined to the joining member of the adjacent face.

In the invention the groove attachment member of the retainer can include a first flexible leg and a second flexible leg with a space therebetween, the first leg and second leg shaped and dimensioned for engaging with the at least one groove of a rail. The first leg and second leg of the groove attachment member of the retainer can further include a locking engagement spur and the groove of the rail further comprises reciprocal continuous indentations so that the retainer may be lockably engaged within the groove. In one embodiment, the locking engagement spur has the shape of a longitudinally cut section of a cyclinder and the indentations of the groove has a reciprocal shape.

The storm window can further include an extender for joining two rails, the extender shaped and dimensioned to have a cross-section substantially the same as that of the engaging cavity of the rails so as to be snugly but slidably insertable therein. It can also include a joint cover with a U-shaped cross-section, wherein a first plate and second plate cover the height of a rail, the first plate and second plate being joined by a third plate with a first side that contacts and covers the width of a rail and a second side, a joining member extending from the second side of the third plate at a right angle to the third plate and in opposite direction from the first plate and second plate, the joining member shaped and dimensioned to be substantially the same as that of the engaging cavity of a rail so as to be snugly but slidably insertable therein, and a groove attachment member extending from the first side of the third plate shaped and dimensioned for engaging with the at least one groove of a rail. The groove attachment member of the joint cover can further include a first flexible leg and a second flexible leg with a space therebetween, the first leg and second leg shaped and dimensioned for engaging with the at least one groove of a rail. This first leg and second leg of the groove attachment member of the joint cover can further include a locking engagement spur with the groove of the rail further including reciprocal continuous indentations so that the retainer may be lockably engaged within the groove.

In a preferred embodiment, the rail is composed of a material which may be cut by means of a saw. Thus the rail may be composed of plastic. The flexible plastic film may be transparent.

The invention further provides for a storm window for fitting within the interior of an existing window frame, wherein at least four rails of a uniform H-shape cross-section are provided, each rail having a uniform width and height with a length determined by the dimensions of the existing window frame, with each end of each rail terminating at a right angle, with an engaging cavity having a defined shape and dimension within the interior along the length of each rail and with a top and bottom groove with a rectangular cross-section defined by the H-shape, each grove having a defined shape and dimension including at least one continuous indentation in the shape of longitudinally cut section of a cylinder along at least one side wall. In this embodiment there are at least four corner brackets, each corner bracket having a first face and second face for contacting rails, the first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein, a third face and fourth face opposite the first face and second face, the third and fourth faces disposed at right angles and each having a groove with a rectangular cross-section and a defined shape and dimension along the face such that the groove is continuous with the groove of a rail joined to the joining member of the adjacent face, and at least one plate extending over at least a portion of the first face and second face for contacting rails, such that the juncture of the corner bracket and rail is at least particularly covered by the plate. In this embodiment a flexible plastic film is provided together with at least four retainers of uniform cross-section, each retainer have a length determined by the dimensions of the existing window frame, with each retainer having a groove attachment member shaped and dimensioned for engaging with the groove of a rail, the groove attachment member including a first flexible leg and a second flexible leg with a space therebetween and at least one locking engagement spur in complementary relationship to the at least one continuous indentation of the groove of the rail so that the groove attachment member may be lockably engaged within the groove, and a flexible spline for compressibly engaging the existing window frame. In this embodiment, the ends of each rail are joined to a corner bracket by means of the joining members so as to form a rectangular shape, the flexible plastic film is positioned on one side of the rectangular shape and is secured by engagement between groove attachment members of the retainers and grooves of the rails, and the resulting rectangular shape with flexible plastic film secured thereto is fitted within the existing window frame by means of compressible engagement of the flexible spines of the retainers.

The foregoing embodiment can further include an extender for joining two rails, the extender shaped and dimensioned to have a cross-section substantially the same as that of the engaging cavity of the rails so as to be snugly but slidably insertable therein. It can further include a joint cover with a U-shaped cross-section, wherein a first plate and second plate cover the height of a rail, such first plate and second plate being joined by a third plate with a first side that contacts and covers the width of a rail and a second side, a joining member extending from the second side third plate at a right angle and opposite direction from the first plate and second plate, the joining member shaped and dimensioned to be substantially the same as that of the engaging cavity of a rail so as to be snugly but slidably insertable therein, and a groove attachment member extending from the first side of the third plate and including a first flexible leg and a second flexible leg with a space therebetween and at least one locking engagement spur in complementary relationship to the at least one continuous indentation of the groove of the so that the groove attachment member may be lockably engaged within the groove.

In this embodiment the rail can be composed of a material which may be cut by means of a saw, and may be composed of plastic. The flexible plastic film may be transparent.

The invention further provides a kit for fabricating a storm window for fitting within the interior of an existing window frame. The kit includes at least the following elements:

At least four rails of a uniform H-shape cross-section, each rail having a uniform width and height with a length determined by the dimensions of the existing window frame, with each end of each rail terminating at a right angle, with an engaging cavity having a defined shape and dimension within the interior along the length of each rail and with a top and bottom groove with a rectangular cross-section defined by the H-shape, each grove having a defined shape and dimension including at least one continuous indentation in the shape of longitudinally cut section of a cylinder along at least one side wall.

At least four corner brackets, each corner bracket having a first face and second face for contacting rails, the first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein, a third face and fourth face opposite the first face and second face, the third and fourth faces disposed at right angles and each having a groove with a rectangular cross-section and a defined shape and dimension along the face such that the groove is continuous with the groove of a rail joined to the joining member of the adjacent face, and at least one plate extending over at least a portion of the first face and second face for contacting rails, such that the juncture of the corner bracket and rail is at least particularly covered by the plate.

At least four retainers of uniform cross-section, each retainer have a length determined by the dimensions of the existing window frame, with each retainer having a groove attachment member shaped and dimensioned for engaging with the groove of a rail, the groove attachment member including a first flexible leg and a second flexible leg with a space therebetween and at least one locking engagement spur in complementary relationship to the at least one continuous indentation of the groove of the rail so that the groove attachment member may be lockably engaged within the groove, and a flexible spline for compressibly engaging the existing window frame.

In the embodiment of the kit, the ends of each rail can be joined to a corner bracket by means of the joining members so as to form a rectangular shape, a flexible plastic film can be positioned on one side of the rectangular shape and secured by engagement between groove attachment members of the retainers and grooves of the rails, and the resulting rectangular shape with flexible plastic film secured thereto can be fitted within the existing window frame by means of compressible engagement of the flexible spines of the retainers.

A primary object of the present invention is to provide a removable window system made from a polymeric material which may be held within a window frame by means of compression.

Another object of the present invention is to provide a removable window system wherein mitered or 45° corners are not employed.

Yet another object of the present invention is to provide a removable window system wherein top or side members may be joined and extended as desired, wherein mullion members may be added as desired or required, and wherein a single retainer member provides at least two functions, including retaining the plastic or other window covering in place and securing the window within a window frame by means of compression.

Yet another object of the present invention is to provide a removable window system wherein components may be secured by means of indentations and reciprocal locking engagement spurs, such that the resulting structure is rigid and strongly joined.

A primary advantage of the present invention is that storm or interior windows may be made of different dimensions solely by means of making right angle cuts of the top or side members, and wherein such cuts are covered by other components of the present invention, such that the result is both structurally sound and aesthetically or cosmetically pleasing.

Another advantage of the present invention is that the components thereof may be readily and inexpensively made from an extruded or molded plastic material.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS (BEST MODES FOR CARRYING OUT THE INVENTION)

Figure 1:
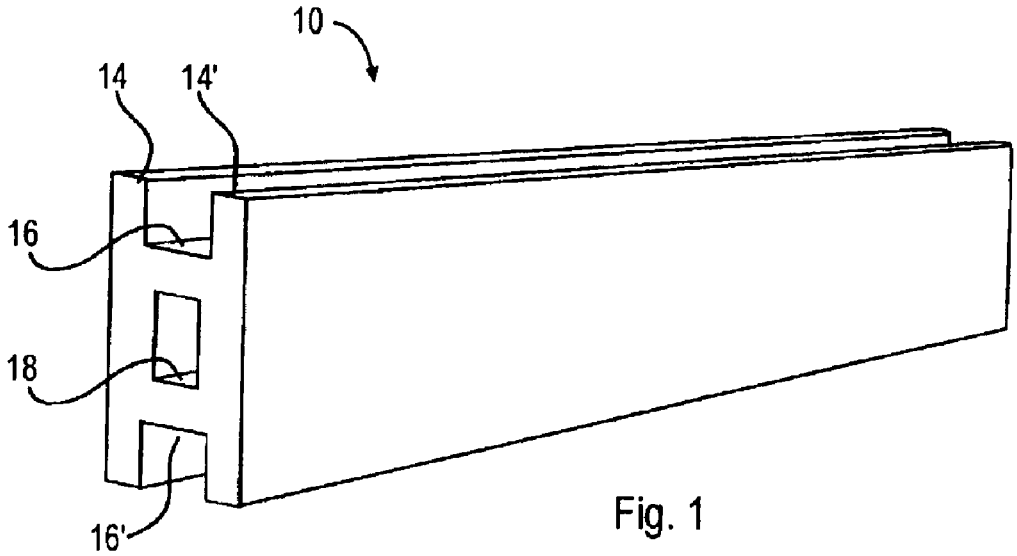
FIG. 1 is a perspective view of an H rail of the invention.

FIG. 1 illustrates H rail 10 employed in the invention. H rail 10 includes side members 14 and 14' and engaging cavity 18 for engaging a connecting member such as extender 40, joining member 24 of groove attachment member 20 or 22, joining member 54 of joint cover 50 or 54, or joining member 118, 118', 138 or 138' of corner bracket 110 or 130. Cavity 18 is complementary to and of the same dimension as extender 40 or any of joining members 24, 54, 118, 118', 138 or 138', such that the extender or joining member fits tightly within cavity 18, being held therein by friction. Side members 14 and 14' define grooves 16 and 16', which grooves are designed to receive a retainer strip, such as retainer strip 80 or 100, or to receive the engagement portion of groove attachment member 20 or 22 or the engagement portion of joint cover 50 or 70.

H rail 10 may be of any convenient dimension to accomplish the objectives and functions described herein. In one embodiment, H rail 10 is approximately 0.75 inches by 1.75 inches by 96 inches in length, with engaging cavity 18 having dimensions of 0.25 inches by 0.5 inches, grooves 16 and 16' having dimensions of 0.375 inches by 0.375 inches, and side members 14 and 14' having a thickness of 0.188 inches. However, it may be understood that the dimensions may be varied, so long as complementary parts engage as provided here, with the functionality as provided herein. The length may be any length convenient for manufacturing, it being understood that that in a preferred embodiment the H rail can be cut by means of a convention saw, and that two or more H rails may be joined together to form a longer rail. In part, dimensions are determined by the choice of materials, strength of the materials, including tensile strength, resiliency, and the like.

H rail 10 and other components, including extender 40, groove attachment members 20 and 22, joint covers 50 and 54, and corner brackets 110 and 130 are made of any suitable resilient material, preferably a polymeric material, such as a plastic. Preferably all components are made of the same material, such as a polyvinyl chloride (PVC) material, rigid polyurethane material, acrylic material or the like. However, any appropriate plastic or plastic-like material, including composite materials and materials made from recycled products, may be employed. In a preferred embodiment, certain components, such as H rail 10, may be made by an extrusion process; other components may be made by conventional molding techniques. These components may be colored or white, and may further be paintable by the ultimate user in order to match existing wall or exterior window colors. In a preferred embodiment, certain components, and particularly H rail components, are made of a material which may be cut using a conventional hand or power saw.

Figure 2:
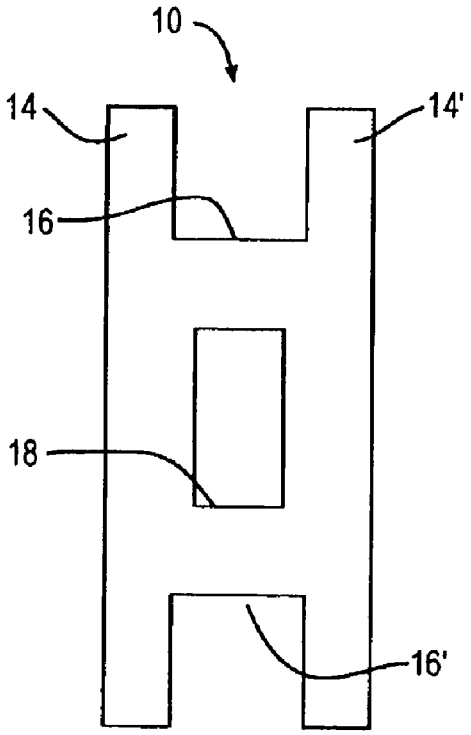
FIG. 2 is a cross section of an H rail of FIG. 1 of the invention.
Figure 3:
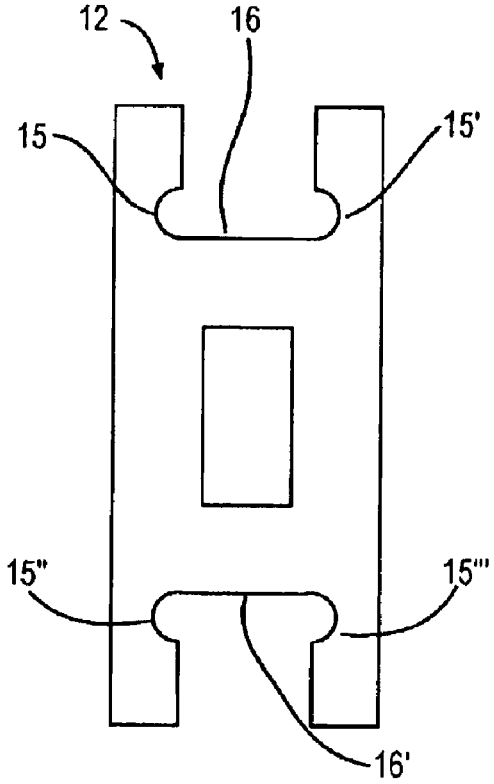
FIG. 3 is a cross section of an H rail with locking indent of the invention.
Figure 19:
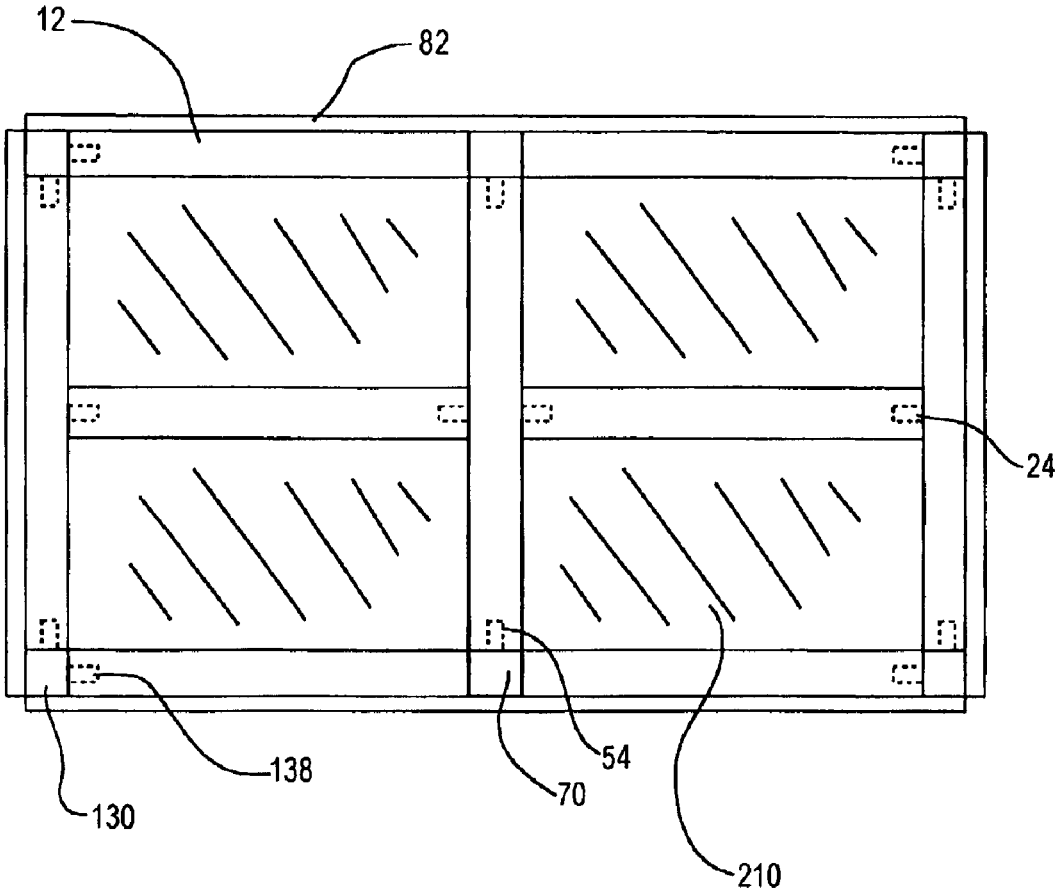
FIG. 19 is a view of a complete insulating window device of this invention positioned within a convention window frame.

FIGS. 2 and 3 depict across section of two different H rail embodiments. H rail 12 shows grooves 16 and 16' wherein the base of such grooves further includes indentations 15, 15', 15" and 15'", where such indentations have the shape of a longitudinally cut section of a cylinder, and are employed for lockably engaging a reciprocal locking engagement spur, such as 28 and 28' of groove attachment member 22, 64 and 64 of joint cover 70, or 92 and 92' of retainer strip 100. It may be seen that the indentations, such as indentation 15, are longitudinally coextensive with the length of H rail 12. The indentations and spurs may be of a reciprocal cylindrical shape as depicted, or may be of any other shape providing engagement, such that the cross-section thereof may be a portion of rectangle or square, a portion of a triangle, a partial ellipse or other shape. It may be seen that a resilient or flexible material is preferably employed with, for example, walls 26 and 26' having thereon reciprocal locking engagement spurs 28 and 28'. The width of groove 16 is dimensioned to tightly receive the engagement portion of groove attachment member 22, such that the bottom portion of walls 26 and 26' may be flexed or bent to permit passage of reciprocal locking engagement spurs 28 and 28' through groove 16 until engagement with indentations 15 and 15'. Channel 30 thus facilitates compression of walls 26 and 26'. FIG. 19 depicts a cross section wherein retainer strip 100 is lockably engaged in H strip 12 by means of a an indentation and reciprocal locking engagement spur.

Figure 4:
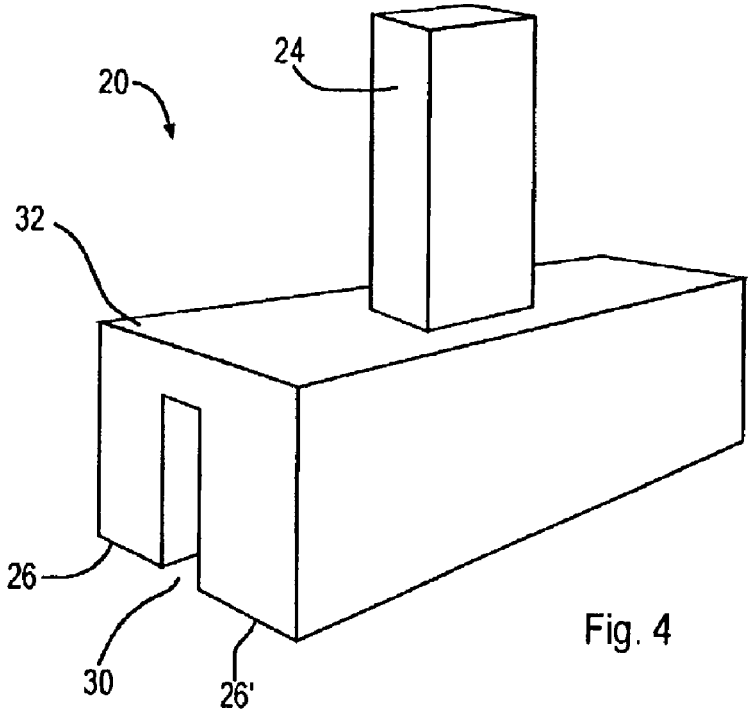
FIG. 4 is a perspective view of a groove attachment member of the invention.
Figure 5:
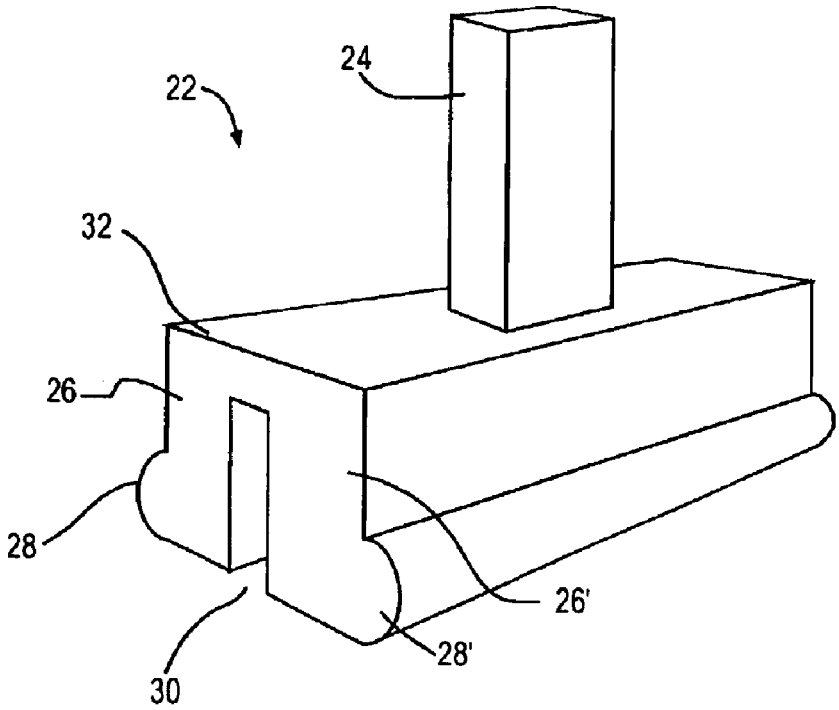
FIG. 5 is a perspective view of a groove attachment member with locking engagement spur of the invention.

FIG. 4 depicts groove attachment member 20, wherein joining member 24 may be engaged with engaging cavity 18, such as of H rail 10, and the remainder of groove attachment member 20 engaged with a groove of an H rail, such as groove 16, such that top surface 32 is coplanar with the tops of side members 14 and 14' of H rail 10. FIG. 5 depicts groove attachment member 22, wherein joining member 24 may be engaged with engaging cavity 18 of H rail 10 or 12, and the remainder of groove attachment member 22 engaged with a groove of an H rail, such as groove 16 of H rail 12, such that top surface 32 is coplanar with the tops of side members 14 and 14' of H rail 12, and spurs 28 and 28' engage with indentations 15 and 15'. Such groove attachment members 20 or 22 may be employed, for example, to secure a mullion member in a rectangular frame, the mullion member being formed of an H rail.

Figure 6:
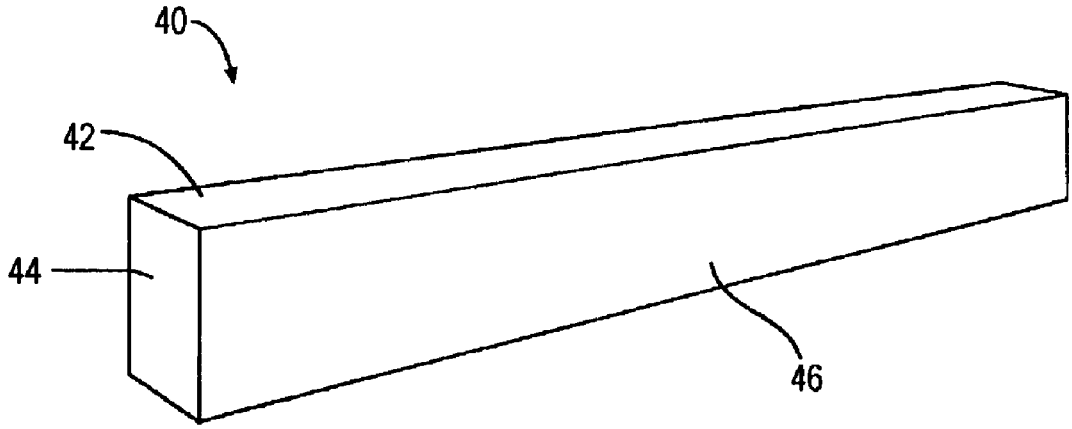
FIG. 6 is an extender of the invention for joining two H rails of FIG. 1 in linear extension.

FIG. 6 depicts extender 40 for joining two H rails; the height and width of extender 40 is dimensioned such as to tightly engage in cavity 18 of an H rail, such that end 44 has approximately the same dimensions as cavity 18, with top 42 and side 46 being any convenient length sufficient to join two H rails with sufficient strength. It may be seen that while extender 40 may be of the same material as the H rail with which it engages, it may also be made from a different material. Thus in one embodiment extender 40 is made from a metal or metal alloy, while the H rail with which it engages is made from a polymeric material, such as an extrudable plastic. In one embodiment, if engaging cavity 18 has dimensions of 0.25 inches by 0.5 inches, then extender 40 is similarly dimensioned, or is undersized by some amount, such as 0.010 inches or less, as to permit tight engagement with engaging cavity 18, and extender 40 further has a length of about 4.0 inches.

Figure 7:
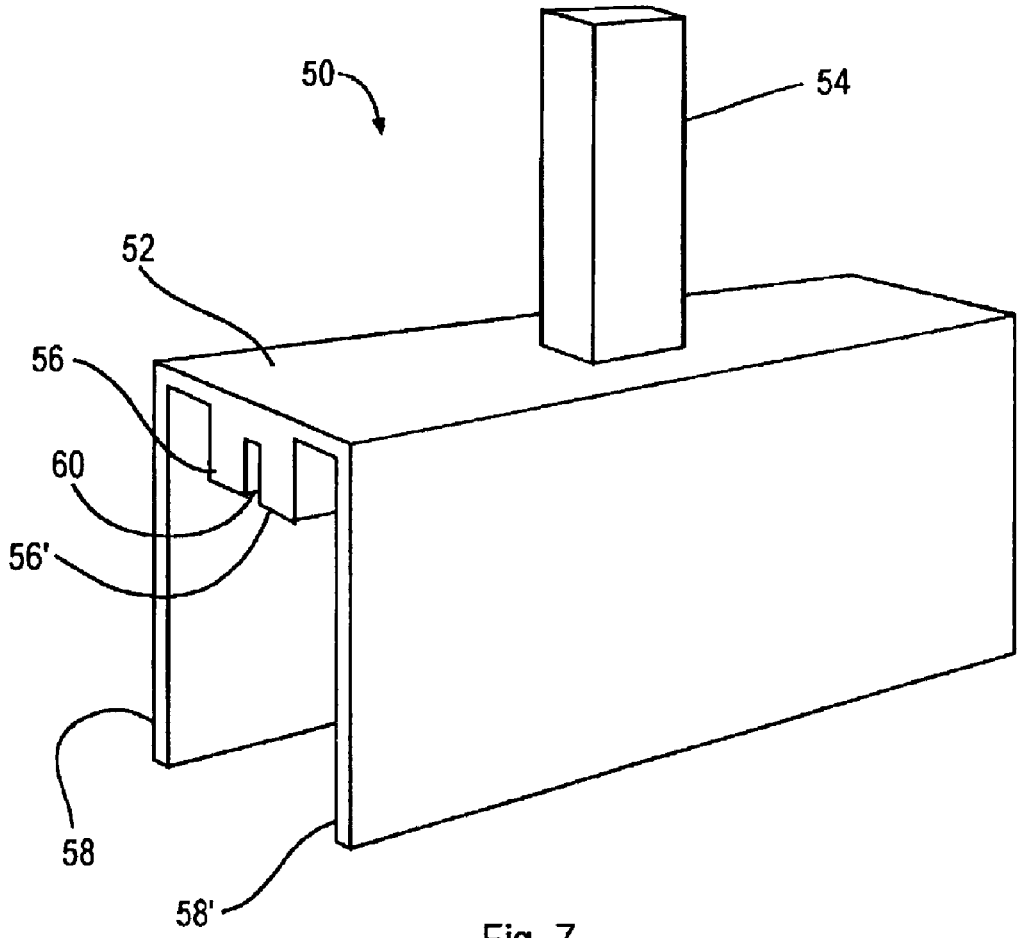
FIG. 7 is a joint cover of the invention for covering a joint formed by the extender of FIG. 6 and further providing an extender for a right angle joint.
Figure 8:
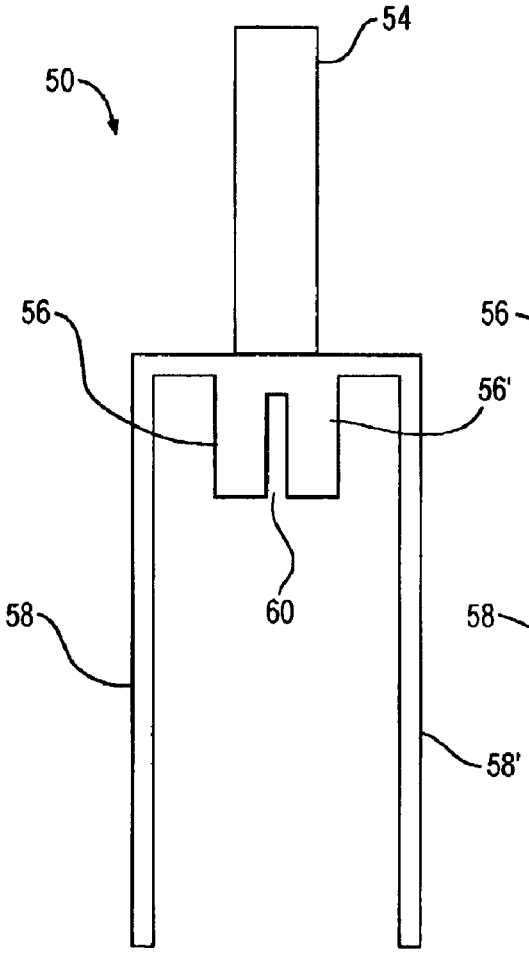
FIG. 8 is a cross section of a Joint cover of FIG. 7 of the invention.
Figure 9:
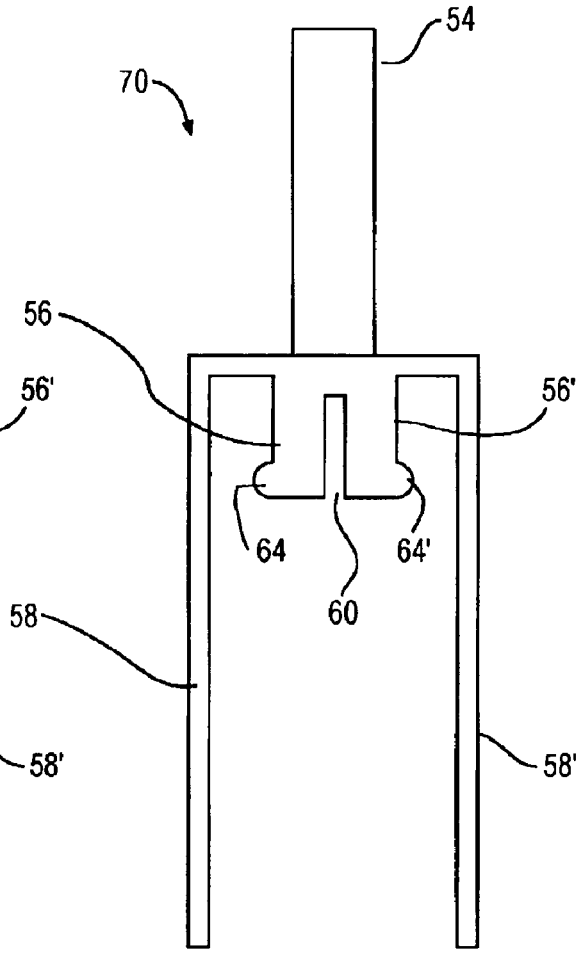
FIG. 9 is a cross section of a joint cover with locking engagement spur of the invention.

FIG. 7 depicts joint cover 50 including joining member 54 which may be engaged with engaging cavity 18, such as of H rail 10. Thus the height and width of joining member 54 is dimensioned such as to tightly engage in cavity 18 of an H rail. Joining member 54 is attached to top surface 52 of joint cover 50, with sides 58 and 58' attached to top surface 52. Groove engaging members 56 and 56', separated by channel 60, can be engaged with a groove of an H rail, such as groove 16. In one embodiment, sides 58 and 58' of joint cover 50 have a height sufficient to fully cover the H rail, such that the bottom of sides 58 and 58' is coplanar with the bottom of the H rail. Joint cover 50 may be employed to secure a mullion member, the mullion member being formed of an H rail, in a rectangular frame. Thus two discrete H rail members, such as H rail 10, may be joined with an extender, such as extender 40, and centered over the juncture of the two discrete H rail members joint cover 50 is engaged, with a third H rail forming a mullion joined by means of joining member 54. It may be seen that in so doing the two discrete H rail members joined end-to-end are secured by multiple means: extender 40 positioned within cavity 18, groove engaging members 56 and 56' engaged with groove 16, and sides 58 and 58' together with top 52 encasing the H rails on three sides, thereby providing a rigid and strong multi-point attachment. It may further be seen that by this means it is not critical to aesthetic or cosmetic appearance that the end cuts of the two abutting H rails be precisely square and true, given that such joint is necessarily covered by sides 58 and 58'. FIGS. 8 and 9 depict two embodiments of the joint cover; joint cover 70 includes reciprocal locking engagement spurs 64 and 64' on groove engaging members 56 and 56' for lockably engaging by means of, for example, indentations 15 and 15' of channel 16 of H rail 12.

Figure 10:
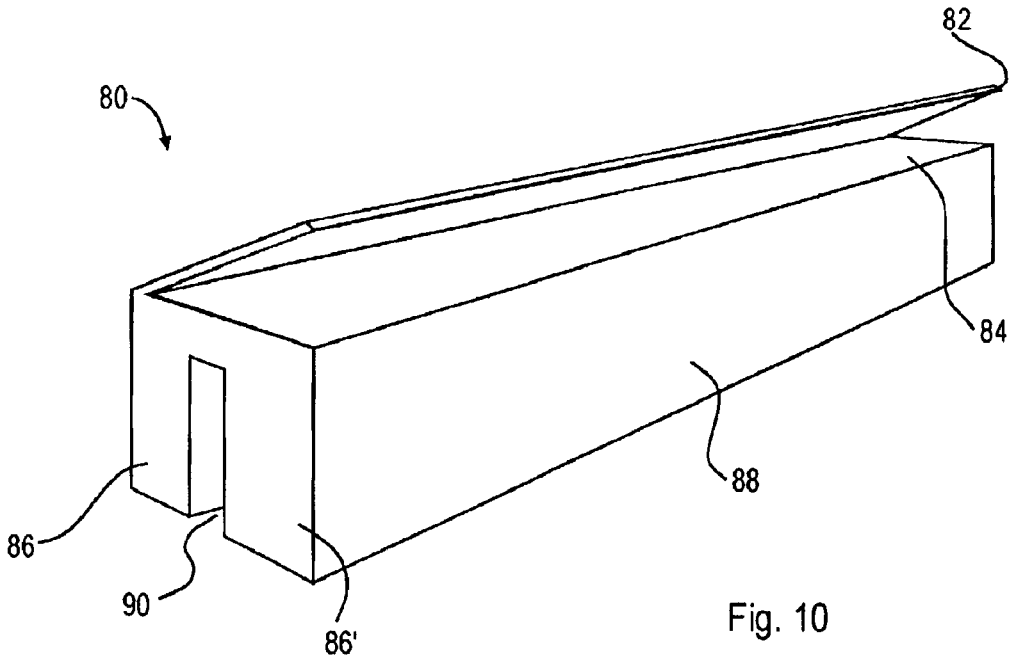
FIG. 10 is a retainer strip of the invention.
Figure 11:
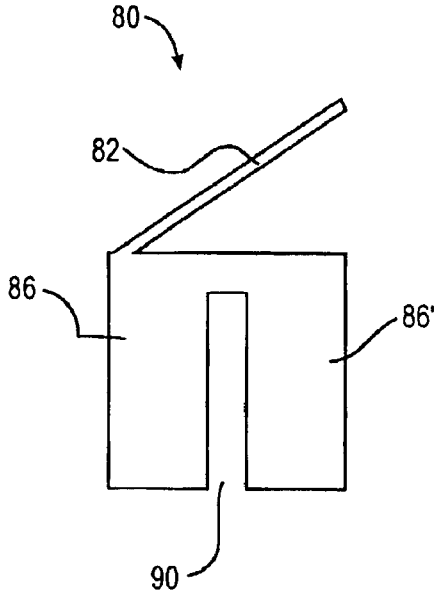
FIG. 11 is a cross section of a retainer strip of FIG. 10 of the invention.
Figure 12:
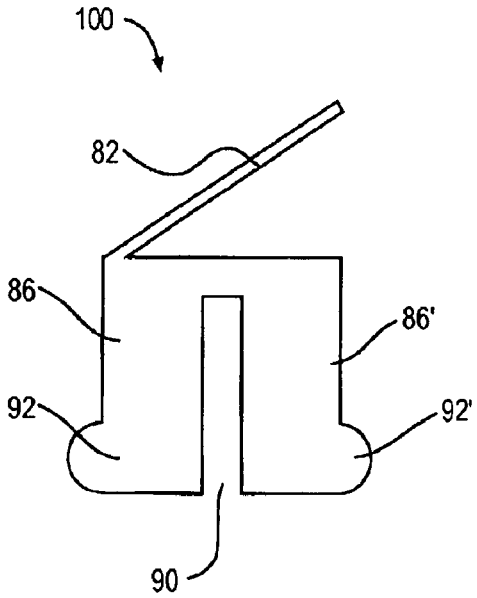
FIG. 12 is a cross section of a retainer strip with locking engagement spur of the invention.

FIG. 10 depicts retainer strip 80 with flexible spline 82, groove engaging members 86 and 86', separated by channel 90, and top surface 84. Groove engaging member 86 and 86' can be engaged with a groove of an H rail, such as groove 16, and in a preferred embodiment top surface 84 is coplanar with the tops of side members 14 and 14' when engaged. Groove engaging members 86 and 86' are dimensioned such as to tightly fit within groove 16 while retaining therein a plastic film, such as film 210 shown in FIG. 19. In one embodiment, a 12 mil thick clear polyvinyl chloride film is employed. The flexible spline 82 secures the interior storm or insulating window of the invention within an existing window frame or opening by means of compression of spline 82, it being understood that the interior storm or insulating window is dimensioned such as to fix and be held by such compression means. FIGS. 11 and 12 depict two embodiments of the retainer strip; retainer strip 100 includes reciprocal locking engagement spurs 92 and 92' on groove engaging members 86 and 86' for lockably engaging by means of indentations 15 and 15' of channel 16 of H rail 12.

Figure 13:
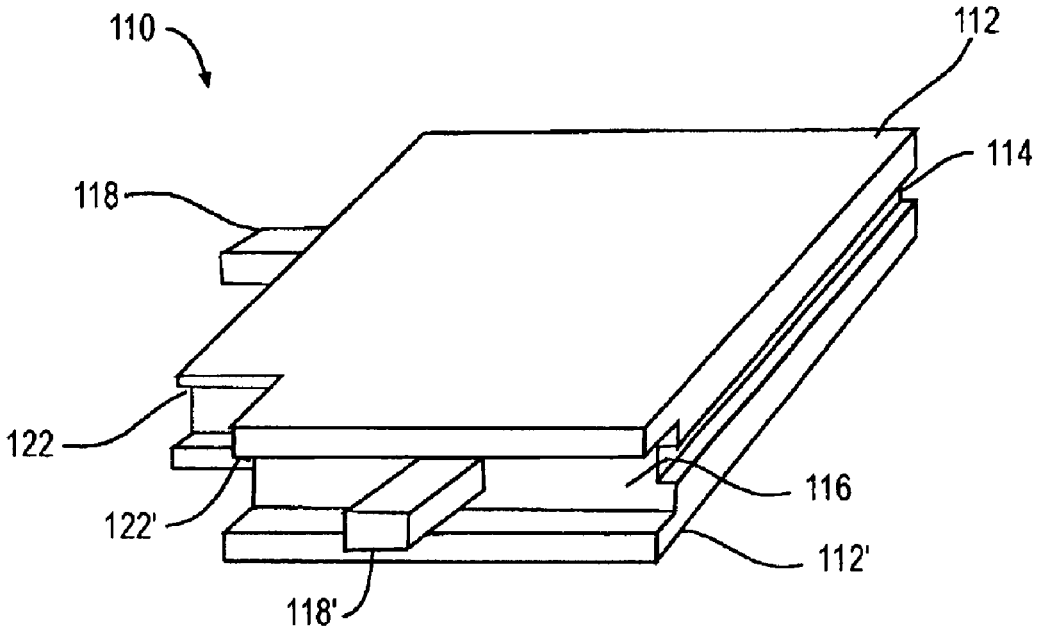
FIG. 13 is a corner bracket of the invention with extenders for engaging H rails of FIG. 1.
Figure 14:
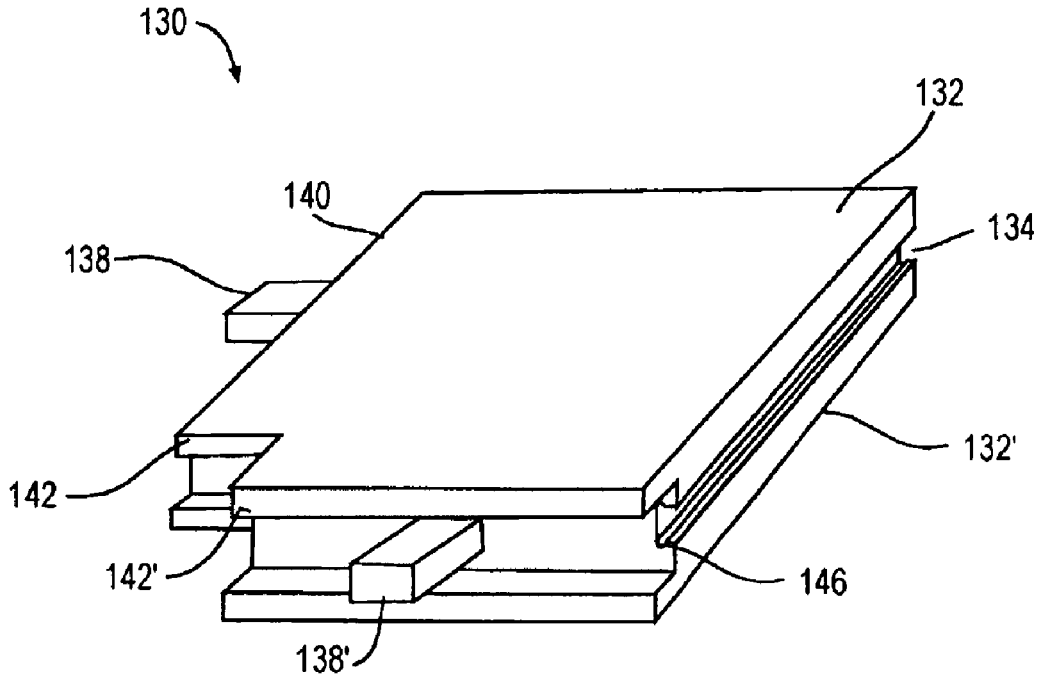
FIG. 14 is a corner bracket of the invention with extenders for engaging H rails of FIG. 1 wherein the exterior grooves may engage a retainer strip of FIG. 10, 11 or 12.
Figure 15:
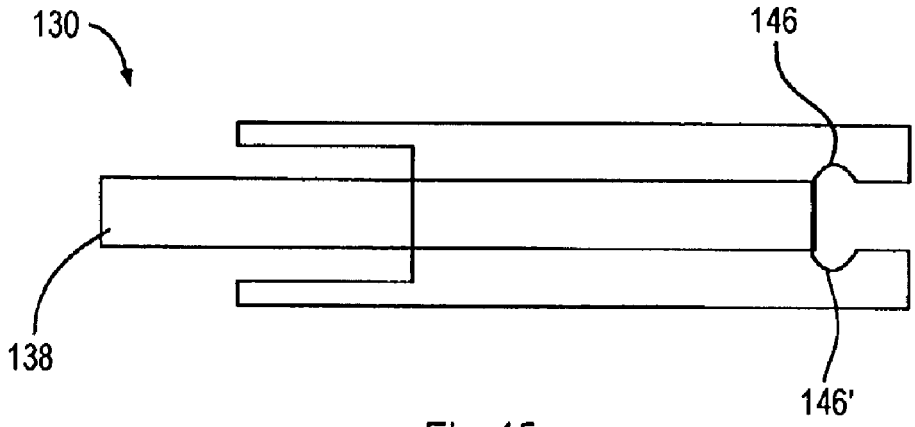
FIG. 15 is a cross-section of the corner bracket of FIG. 14 of the invention.
Figure 16:
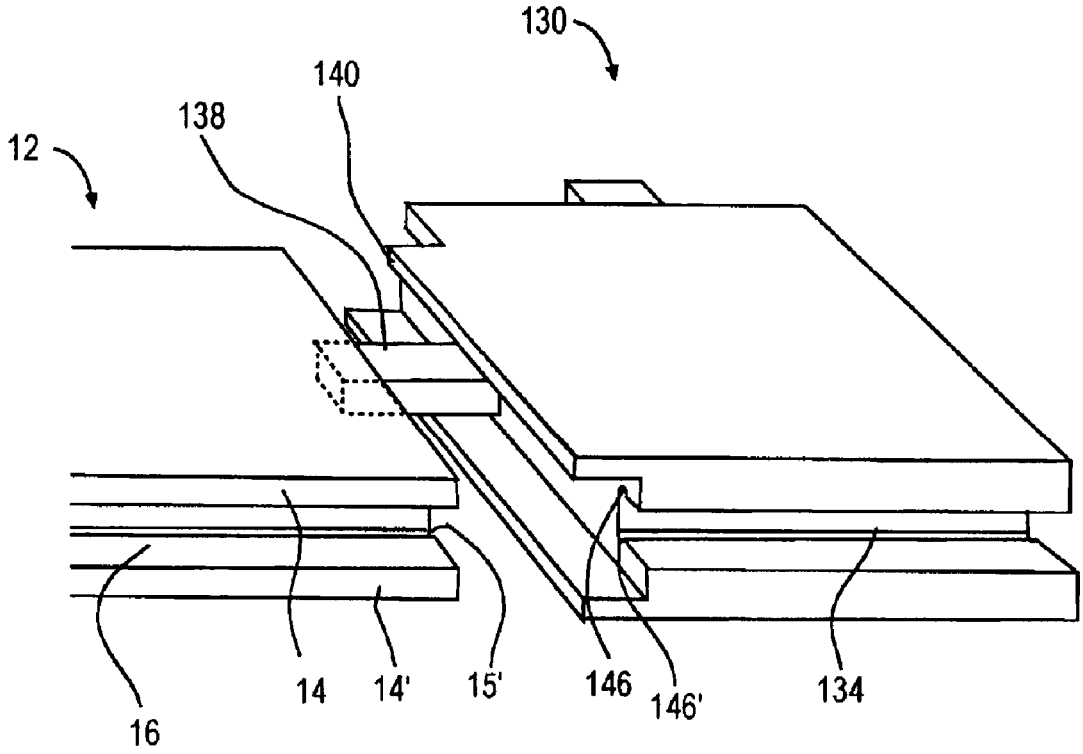
FIG. 16 illustrates a corner bracket of FIG. 14 engaging an H rail of FIG. 1.
Figure 17:
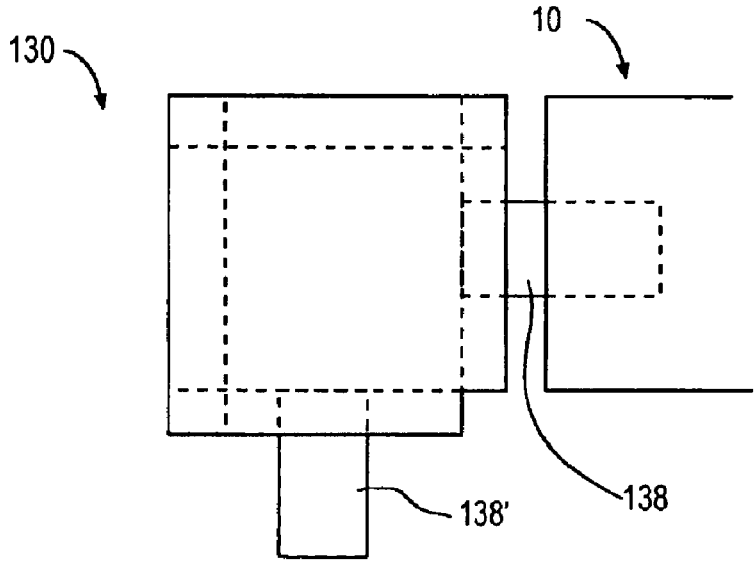
FIG. 17 is a top view of the corner bracket of FIG. 14 of the invention.

FIG. 13 depicts corner bracket 110 for joining two H rails in a 90° joint. Comer bracket 110 includes joining member 118 and 118' for joining two H rails; the height and width of joining members 118 and 118' are dimensioned such as to tightly engage in cavity 18 of an H rail. Top plate 112 and 112' is constructed such that it extends over the end portion of the H rail when the H rail is fully engaged with either joining member 118 or 118'. The amount of overhang or extension of the top plate may be varied, it being understood that corner cut-out portions 122 and 122' are defined by the amount of overhang or extension. In one embodiment the extension extends for approximately 0.25 inches. Preferably the amount of overhang or extension is sufficient to hide any aesthetic or cosmetic imperfections resulting from cutting of the H rail, such as scratch marks, cutting at an angle other than a right angle, or making a cut in other than a straight line, and to more preferably additionally provide additional rigidity and structural integrity to the joint. Thus the height of end 116 is equal to the width of the H rail, so as to permit tight joining therein. Groove 114 is dimensioned the same as groove 16, such that retainer strip 80 or similar pieces may be continuously placed in the H rail and the corner bracket by means of the continuous same-dimension groove. FIG. 14 provides corner bracket 130, with joining members 138 and 138' for joining two H rails; lop plate 132 and 132' further defining corner cut-out portions 142 and 142' defined by the amount of overhang or extension; and groove 134, which further includes indentation 146 employed for lockably engaging a reciprocal locking engagement spur, such as 92 or 92' of retainer strip 100. FIG. 15 shows a cross section of corner bracket 130, wherein both top and bottom indentations 146 and 146' are both shown. When H rail 12 is joined with corner bracket 130 as shown in FIG. 16, it may be seen that groove 16 is continuous with groove 134 and that indentations 15 and 15' are continuous with indentations 146 and 146'. FIG. 17 similarly shows a top perspective of H rail 12 in partial connection with a corner bracket 130.

Figure 18:
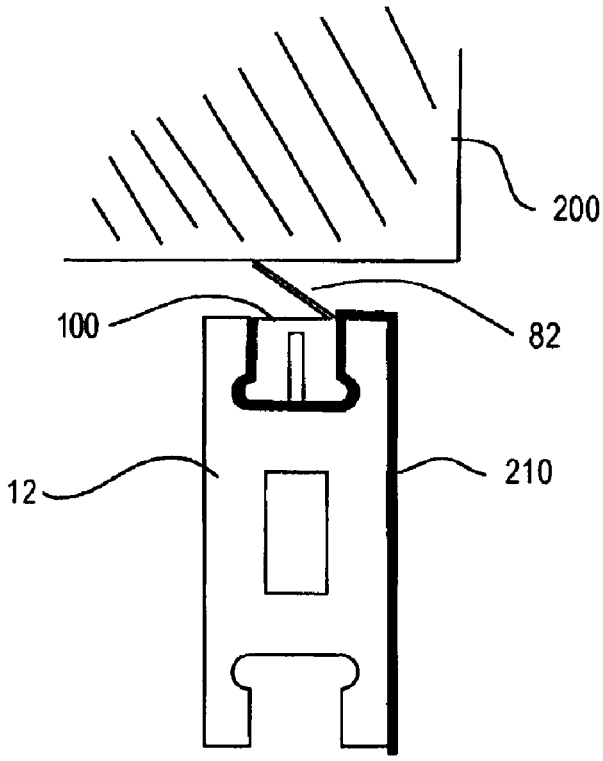
FIG. 18 is a cross-section view of an H rail of FIG. 1 with a retainer strip of FIG. 10 engaging a flexible plastic covering and positioned within a window frame.

FIG. 18 shows a partial cross section of an interior insulating window of this invention in place within a conventional window frame, including H rail 12 held against and within window frame 200 by means of spline 82 of retainer 100, wherein film 210 is held in place by retainer 100. FIG. 19 shows a front view of an interior insulating window of this invention, including H rail 12, the visible portion of spline 82, corners 130 including extenders 138, joint cover 70 and joining member 54, joining member 24 of groove attachment member 22, and film 210.

The corner brackets and H rail components are designed such that they slip together, and optionally are frictionally locked together, or alternatively locked together through use of locking means, such as an indentation and reciprocal spur. Use of a corner bracket provides for use of H rail components that are square cut on the ends, rather than mitered to form angled joints. Thus a pair of H rails may be jointed together at right angles by use of the corner bracket, but with the ends of the H rails cut at a 90° angle to the desired length. H rails may cut using a simple cutting means, such as a manual or power saw, to make a right angle cut. Alternatively, H rails may be provided in a variety of different lengths. H rails may be joined together, such as by means of an extender and optionally a joint cover. It is also possible and contemplated that a resulting window is divided into any number of "panes" desired, such H rails, groove attachment members, extenders and joint covers as required.

In a typical installation, the window opening is first measured. Four H rails are cut to the correspond to the proper height and width measurements, after subtracting from such dimensions the length or width of the rail brackets to be position at each end of each H rail, and an additional amount for the compressible range of spline 82. Retainers are cut for the lengths and widths defined by the H rail and the corner brackets. A corner bracket is inserted into one end of each H rail. It is to be noted that the H rails can and conventionally are constructed such that there is no predetermined front or back side, such that the H rail may be "flipped" during installation as appropriate. The four H rails are then joined together, using the corner brackets, to form a rectangular frame of a slightly smaller dimension than the window opening as measured. The frame is then placed on top of a window film, such as a plastic window film, and the window film folded over one end of the frame. The plastic film is then secured to the H railing by means of the retainer, and this process is repeated on each of the four sides. The retainer may be cut to an appropriate length, if necessary, using any convenient cuttings means. Any excess window film is trimmed and removed. The finished storm window is then placed within the window opening, with the spline of the retainer providing a compressive fit to hold the frame in place. The frame may be similarly removed, conveniently by pulling the frame from the window opening. The interior grooves of the H rails provide a convenient means for grasping the frame for removal, thereby making removal easier in the case of emergency, such as a fire.

For greater structural integrity for large windows, or for aesthetic or cosmetic considerations, the window may be divided into "panes" by means of groove attachment members or joint covers, thereby forming a mullion tee. Such mullion tees may be inserted along the length of an H rail, thus providing divided rectangular sections to the storm window. Similarly, a straight extender may be employed to extent the length of an H rail.

Any of a variety of plastic films 210 may be used with the storm window of this invention. In one embodiment, a flexible, dear and soft vinyl film is utilized, such as a 12 mil thick polyvinyl chloride film with added ultra-violet ray inhibitors, plasticizers for increased pliability, and heat stabilizers. These films may be obtained in any of a variety of widths and lengths. It is also possible and contemplated that, depending on the application, such film may be colored, such as to provide filtered light, or may be translucent rather than transparent. For certain applications a screen, such as a woven screen of a plastic material, may be employed.

Kits are further provided, including the various components of the invention. Use of the invention, including the kit and system, provides a number of advantages. Construction may be accomplished by persons that are not professionals, with a minimum of tools required for assembly. The plastic film is secured to the frame of the storm window, and thus the storm window may be removed and replaced without disturbing mounting of the plastic film within the frame of the storm window. When positioned within a window frame, the plastic film cannot be removed since the retainer spline provides compressive force holding the plastic film in place. However, the storm window may be easily and conveniently removed simply by pulling the storm window from the window frame in which it is positioned.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A storm window adapted for fitting within the interior of an existing window frame, the storm window comprising:

at least four rails of uniform cross-section, each rail having a uniform width and height with a length determined by the dimensions of the existing window frame, with each end of each rail terminating at a right angle, with an engaging cavity having a defined shape and dimension within the interior along the length of each rail and with at least one groove with a defined shape and dimension along at least one width of each rail;

at least four corner brackets, each corner bracket having a first face and second face for contacting rails, said first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein;

a flexible plastic film; and, at least four retainers of uniform cross-section, each retainer have a length determined by the dimensions of the existing window frame, with each retainer having a groove attachment member shaped and dimensioned for engaging with the at least one groove of a rail, and a resilient spline adapted for compressibly engaging the existing window frame;

whereby the ends of each rail are joined to a corner bracket by the joining members so as to form a rectangular shape, the flexible plastic film is positioned on one side of the rectangular shape and is secured by engagement between groove attachment members of the retainers and grooves of the rails, and the resulting rectangular shape with flexible plastic film secured thereto is adapted to be secured within the existing window frame by compressible engagement of the resilient spines of the retainers.

2. The storm window of claim 1, wherein the corner brackets further comprise at least one plate extending over at least a portion of the first face and second face for contacting rails, such that the juncture of the corner bracket and rail is at least particularly covered by the plate.

3. The storm window of claim 1, wherein the corner brackets further comprise a third face and fourth face opposite the first face and second face, the third and fourth faces disposed at right angles and each having a groove with a defined shape and dimension along the face such that the groove is continuous with the groove of a rail joined to the joining member of the adjacent face.

4. The storm window of claim 1, wherein the groove attachment member of the retainer comprises a first resilient leg and a second resilient leg with a space there between, the first leg and second leg shaped and dimensioned for engaging with the at least one groove of a rail.

5. The storm window of claim 4, wherein the first leg and second leg of the groove attachment member of the retainer further comprise a locking engagement spur and the groove of the rail further comprises reciprocal continuous indentations so that the retainer may be lockably engaged within the groove.

6. The storm window of claim 5, wherein the locking engagement spur has the shape of a longitudinally cut section of a cylinder and the indentations of the groove has a reciprocal shape.

7. The storm window of claim 1, further comprising an extender for joining two rails, the extender shaped and dimensioned to be substantially the same as that of the engaging cavity of the rails so as to be snugly but slidably insertable therein.

8. The storm window of claim 1, further comprising a joint cover with a U-shaped cross-section, wherein a first plate and second plate cover the height of a rail, such first plate and second plate being joined by a third plate with a first side that contacts and covers the width of a rail and a second side, a joining member extending from the second side third plate at a right angle and opposite direction from the first plate and second plate, the joining member shaped and dimensioned to be substantially the same as that of the engaging cavity of a rail so as to be snugly but slidably insertable therein, and a groove attachment member extending from the first side of the third plate shaped and dimensioned for engaging with the at least one groove of a rail.

9. The storm window of claim 8, wherein the groove attachment member of the joint cover comprises a first resilient leg and a second resilient leg with a space therebetween, the first leg and second leg shaped and dimensioned for engaging with the at least one groove of a rail.

10. The storm window of claim 9, wherein the first leg and second leg of the groove attachment member of the joint cover further comprise a locking engagement spur and the groove of the rail further comprises reciprocal continuous indentations so that the retainer may be lockably engaged within the groove.

11. The storm window of claim 1, wherein the rail is composed of a material which may be cut by of a saw.

12. The storm window of claim 1, wherein the rail is a composed of plastic.

13. The storm window of claim 1, wherein the flexible plastic film is transparent.

14. A storm window adapted for fitting within the interior of an existing window frame, the storm window comprising:

at least four rails of a uniform H-shape cross-section, each rail having a uniform width and height with a length determined by the dimensions of the existing window frame, with each end of each rail terminating at a right angle, with an engaging cavity having a defined shape and dimension within the interior along the length of each rail and with a top and bottom groove with a rectangular cross-section defined by the H-shape, each grove having a defined shape and dimension including at least one continuous indentation in the shape of longitudinally cut section of a cylinder along at least one side wall;

at least four corner brackets, each corner bracket having a first face and second face for contacting rails, said first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein, a third face and fourth face opposite the first face and second face, the third and fourth faces disposed at right angles and each having a groove with a rectangular cross-section and a defined shape and dimension along the face such that the groove is continuous with the groove of a rail joined to the joining member of the adjacent face, and at least one plate extending over at least a portion of the first face and second face for contacting rails, such that the juncture of the corner bracket and rail is at least particularly covered by the plate;

a flexible plastic film; and, at least four retainers of uniform cross-section, each retainer have a length determined by the dimensions of the existing window frame, with each retainer having a groove attachment member shaped and dimensioned for engaging with the groove of a rail, the groove attachment member including a first resilient leg and a second resilient leg with a space there between and at least one locking engagement spur in complementary relationship to the at least one continuous indentation of the groove of the so that the groove attachment member may be lockably engaged within the groove, and a resilient spline adapted for compressibly engaging the existing window frame;

whereby the ends of each rail are joined to a corner bracket by the joining members so as to form a rectangular shape, the flexible plastic film is positioned on one side of the rectangular shape and is secured by engagement between groove attachment members of the retainers and grooves of the rails, and the resulting rectangular shape with flexible plastic film secured thereto is adapted to be secured within the existing window frame by compressible engagement of the resilient spines of the retainers.

15. The storm window of claim 14, further comprising an extender for joining two rails, the extender shaped and dimensioned to be substantially the same as that of the engaging cavity of the rails so as to be snugly but slidably insertable therein.

16. The storm window of claim 14, further comprising a joint cover with a U-shaped cross-section, wherein a first plate and second plate cover the height of a rail, such first plate and second plate being joined by a third plate with a first side that contacts and covers the width of a rail and a second side, a joining member extending from the second side third plate at a right angle and opposite direction from the first plate and second plate, the joining member shaped and dimensioned to be substantially the same as that of the engaging cavity of a rail so as to be snugly but slidably insertable therein, and a groove attachment member extending from the first side of the third plate and including a first resilient leg and a second resilient leg with a space there between and at least one locking engagement spur in complementary relationship to the at least one continuous indentation of the groove of the so that the groove attachment member may be lockably engaged within the groove.

17. The storm window of claim 14, wherein the rail is composed of a material which may be cut by a saw.

18. The storm window of claim 14, wherein the rail is a composed of plastic.

19. The storm window of claim 14, wherein the flexible plastic film is transparent.

20. A kit for fabricating a storm window adapted for fitting within the interior of an existing window frame, the kit comprising:

at least four rails of a uniform H-shape cross-section, each rail having a uniform width and height with a length determined by the dimensions of the existing window frame, with each end of each rail terminating at a right angle, with an engaging cavity having a defined shape and dimension within the interior along the length of each rail and with a top and bottom groove with a rectangular cross-section defined by the H-shape, each grove having a defined shape and dimension including at least one continuous indentation in the shape of longitudinally cut section of a cylinder along at least one side wall;

at least four corner brackets, each corner bracket having a first face and second face for contacting rails, said first and second faces disposed at right angles, with the first and second faces further having a joining member extending from each first and second face at a right angle, each joining member shaped and dimensioned to be substantially the same as that of the engaging cavity of the rails so as to be snugly but slidably insertable therein, a third face and fourth face opposite the first face and second face, the third and fourth faces disposed at right angles and each having a groove with a rectangular cross-section and a defined shape and dimension along the face such that the groove is continuous with the groove of a rail joined to the joining member of the adjacent face, and at least one plate extending over at least a portion of the first face and second face for contacting rails, such that the juncture of the corner bracket and rail is at least particularly covered by the plate;

a flexible plastic film; and, at least four retainers of uniform cross-section, each retainer have a length determined by the dimensions of the existing window frame, with each retainer having a groove attachment member shaped and dimensioned for engaging with the groove of a rail, the groove attachment member including a first resilient leg and a second resilient leg with a space there between and at least one locking engagement spur in complementary relationship to the at least one continuous indentation of the groove of the so that the groove attachment member may be lockably engaged within the groove, and a resilient spline adapted for compressibly engaging the existing window frame;

whereby the ends of each rail can be joined to a corner bracket by the joining members so as to form a rectangular shape, the flexible plastic film can be positioned on one side of the rectangular shape and secured by engagement between groove attachment members of the retainers and grooves of the rails, and the resulting rectangular shape with flexible plastic film secured thereto can be adapted to be secured within the existing window frame by compressible engagement of the resilient spines of the retainers.

* * * * *